United States Patent [19]

Backus

[11] Patent Number: 4,476,798

[45] Date of Patent: Oct. 16, 1984

[54] INTEGRATED MULTIPLE PURPOSE UNIVERSAL SHIP HULL AND REPLACEMENT MODULE SYSTEM

[75] Inventor: George S. Backus, Bremerton, Wash.

[73] Assignee: Consolidated Olympic Corporation, Silverdate, Wash.

[21] Appl. No.: 408,910

[22] Filed: Aug. 17, 1982

[51] Int. Cl.[3] ..... B63B 3/08

[52] U.S. Cl. ..... 114/77 R; 114/255

[58] Field of Search ..... 114/77 R, 77 A, 352, 114/354, 357, 39, 255, 259, 260; 62/240, 433; 220/308, 310, 358

[56] References Cited

U.S. PATENT DOCUMENTS

| | | | |
|---|---|---|---|
| 1,113,173 | 10/1914 | Kovalevitch . | |
| 1,813,248 | 7/1931 | Mestice . | |
| 2,052,407 | 8/1936 | King | 62/433 X |
| 2,368,441 | 1/1945 | Bedford . | |
| 2,369,265 | 2/1945 | Thiel, Jr. . | |
| 2,406,084 | 8/1946 | Levin . | |
| 2,513,004 | 6/1950 | Cooley | 62/433 X |
| 3,139,197 | 6/1964 | Bylo . | |
| 3,158,882 | 12/1964 | Kibby . | |
| 3,371,639 | 3/1968 | Schillreff . | |
| 3,383,720 | 5/1968 | Greig et al. | 114/357 |
| 3,687,334 | 8/1972 | McNeil | 220/308 |
| 3,796,176 | 3/1974 | Garcia | 114/77 R |
| 3,841,254 | 10/1974 | Dragonas et al. | 114/77 R |
| 3,916,468 | 11/1975 | Tetreault et al. | 114/352 |
| 4,031,838 | 6/1977 | Schmidt | 114/77 A X |
| 4,068,611 | 1/1978 | Leather | 114/39 |
| 4,286,535 | 9/1981 | Lunn | 114/77 R |

*Primary Examiner*—Sherman D. Basinger

*Attorney, Agent, or Firm*—Christensen, O'Connor, Johnson & Kindness

[57] ABSTRACT

An integral hull and module system (10) includes a universal hull (12) configured to conveniently accept various modules (100) to convert the system (10) to different operational functions. Hull (12) includes an inner hull structure (24) for downwardly, slidably receiving the outer shell (102) of module (100) which is common to each module (100). To facilitate insertion of module outer shell (102) within inner hull structure (24), the side and end walls (126, 128 and 130) of the module outer shell are sloped inwardly to match the slope of side walls and end walls (26, 28, 30) which compose the sides of inner hull structure (24). Vertical keys (138) are formed on the exterior portions of the side walls of module outer shell (102) to slidably engage within corresponding keyways (42) formed in the side and end walls of inner hull (24) to properly align and prevent lateral movement of module (100) relative to hull (12).

24 Claims, 9 Drawing Figures

192
192
192
192
190
190
190
218
204
100
130
102
10
126
138
128
138
206

18
42
30
34
26
42
22
20
11
40
38
40
166
24
12
36
32
16
28
100
170
174
182
102
138
128
136
138
126
164
132
134
136

Fig. 3
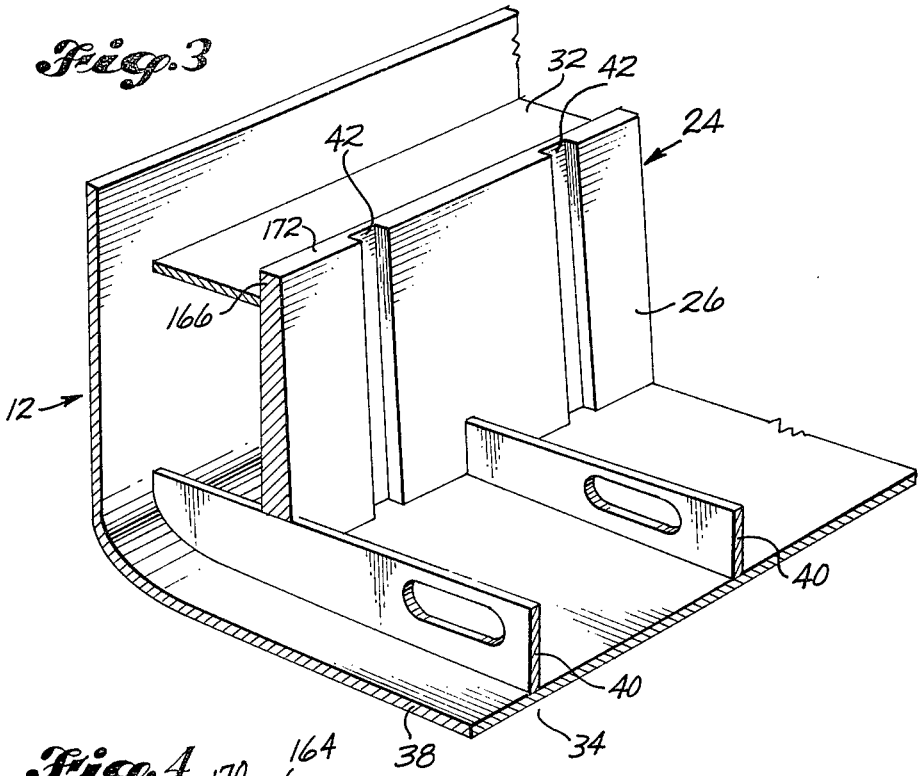
Fig. 4
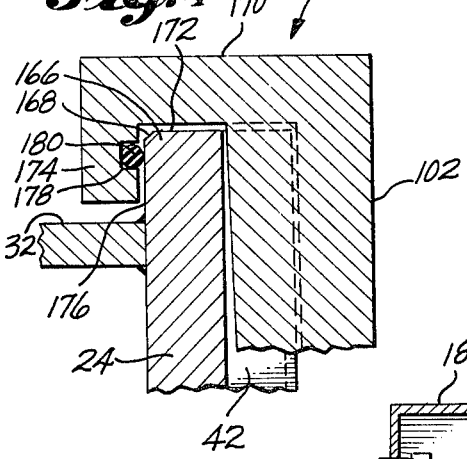
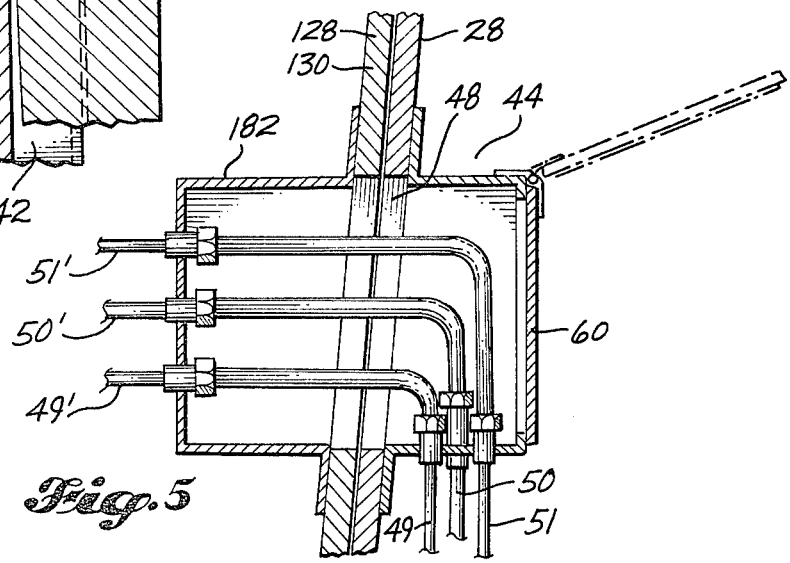
Fig. 5

Fig. 6
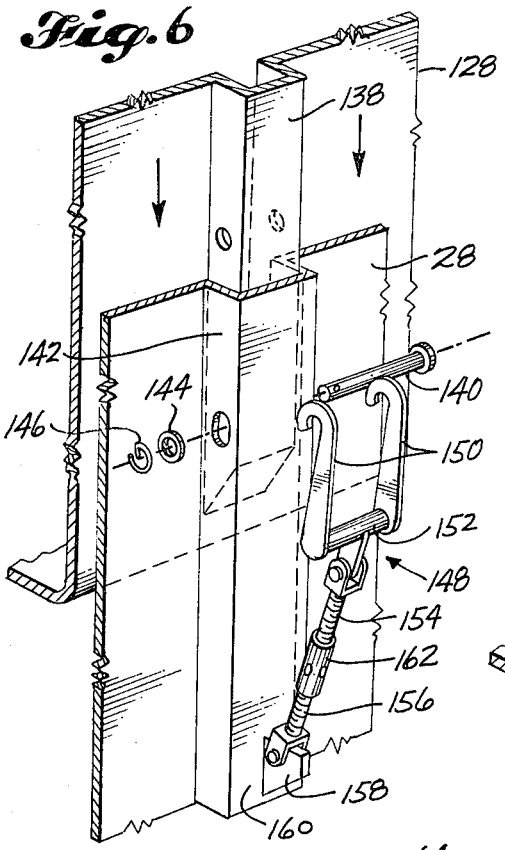
Fig. 7
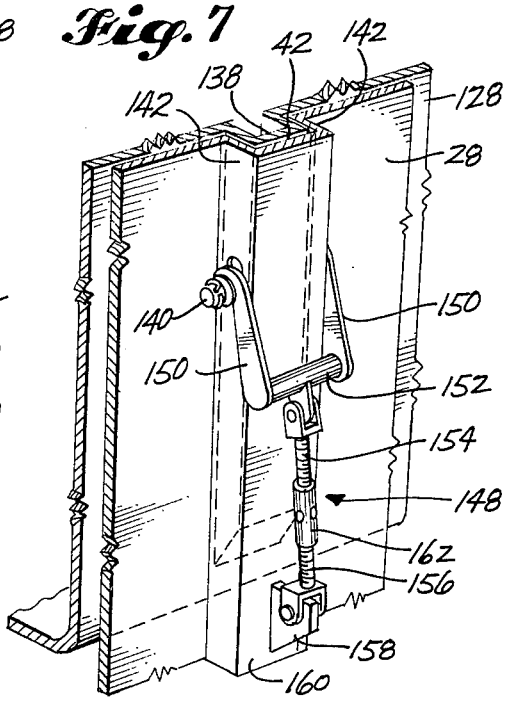
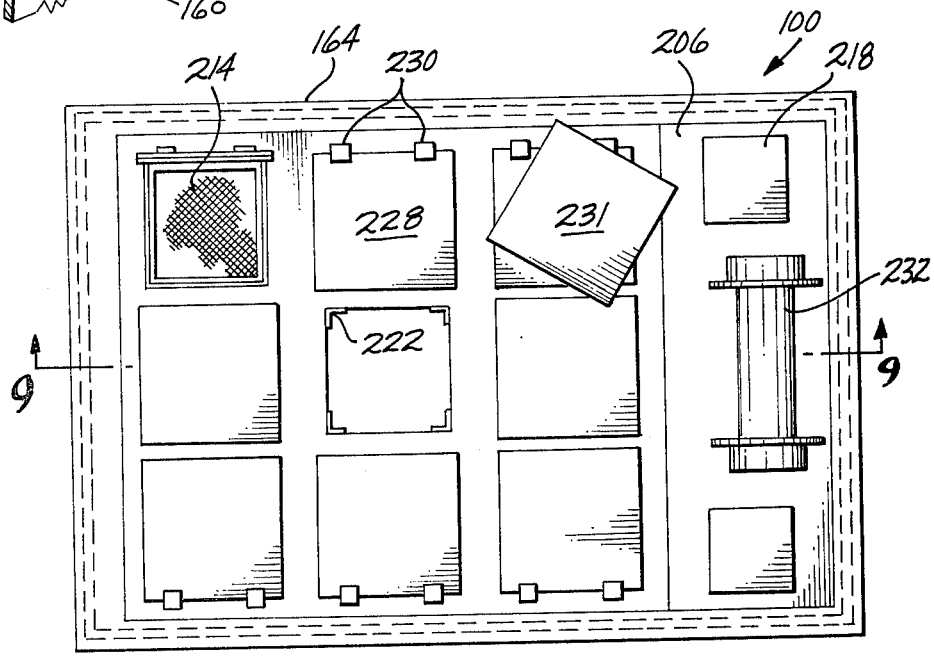
Fig. 8

INTEGRATED MULTIPLE PURPOSE UNIVERSAL SHIP HULL AND REPLACEMENT MODULE SYSTEM

DESCRIPTION

1. Technical Field

The present invention relates to marine vessels, and more particularly to an integrated system composed of a universal hull which interchangeably accepts various modules designed for different operational functions.

2. Background Art

Vessels are typically designed for a particular type of service, i.e. fishing, patrol, commerce or research. As a result the vessels are commonly idle for significant periods of time, for instance between fishing seasons. Also, fishing boats are usually rigged for only one type of fishing, such as trolling. Thus, after the trolling season is over, the boat may lay idle for the remainder of the year, rather than being used in other types of fishing, such as seining.

Thus, it is a primary object of the present invention to provide an integrated multiple purpose universal hull and replaceable module system for conveniently and quickly converting a vessel from one service use to another as operational requirements demand. A specific module may be simply lowered into a universal hull and then secured to the hull with a minimum of operational steps. As a result, a single hull may be used in conjunction with numerous modules each designed for a specific service, such as fishing, patrol, commerce or research. By the present invention, the hull, which composes the major expense item of the vessel, may be efficiently continually utilized rather than laying idle for long lengths of time as now typically occurs with conventional vessels. Also, modules, not in use, may be maintained during this time period.

The prior art does include various types of ships constructed or composed of detachable or removable sections. In one known type of ship construction, the hull is composed of a lower or keel section and a floatable upper or superimposed section. If the keel section is seriously damaged, perhaps causing it to take on water, the upper section can be severed from the keel section to allow the keel section to sink without also carrying down the upper section. Examples of ships constructed in this manner are disclosed by U.S. Pat. Nos. 1,113,173; and 1,813,248.

It is also known to construct sectional cargo or tanker ships for receiving rather large, floating cargo containers. The containers are preloaded at the dock site and then floated into position by use of winches, tug boats or other motorized devices and then attached to the skeletal portion of the ship. In U.S. Pat. Nos. 2,406,084; 3,796,176; and 3,841,254, a plurality of individual cargo containers are floated into and out of cargo spaces formed by the skeletal portion of a ship. In U.S. Pat. Nos. 2,369,265 and 3,139,197, the container portion of the ship is in the form of singular barge which itself is constructed with a plurality of cargo holds. The containers or barges of these ships can be preloaded to reduce the time required for discharging and taking on cargo at a port. Also this type of ship construction allows the ships to call on ports which do not have the docking facilities to accommodate extremely large sized ships.

It is further known to construct ships with prefabricated superstructure portions to enable the hull and superstructure of the ship to be manufactured at the same time, thereby reducing the time required to build or overhaul a ship. Also, this type of construction enables individual components of large ships, especially military ships, to be tested at a shore facility prior to installation on the ship at a shipyard. Examples of ships utilizing this type of construction are illustrated by U.S. Pat. Nos. 2,368,441; 3,371,639; and 4,031,838. In each of these patents, the superstructure units are attached and secured to the ships on a permanent or semipermanent basis thereby requiring rather complicated structures and time-consuming procedures for mounting the prefabricated units onto a ship, or removing the prefabricated units from the ship. Also, the prefabricated units are not designed to change the function or essential character of the ship, but rather are used to reduce the time required to construct or overhaul the ship.

DISCLOSURE OF THE INVENTION

An integrated vessel hull and module system of the present invention includes a universal hull capable of accepting different modules designed for various operational purposes to thereby conveniently converting the system to accomplish different operational functions, such as fishing, carrying personnel or cargo, conducting ocean or fresh water research, or patrolling. The universal hull provides services for all vessel standard operations including propulsion, navigation, crew housing and module support. The hull is constructed with an inner hull structure composed of interior upright side and end walls which extend downwardly from the hull deck to intersect a floor structure near the bottom of the hull thereby forming an upwardly open well. In a preferred form of the present invention, the well occupies substantially the entire width of the vessel and at least one-half of the length of the vessel. However, it is to be understood that the size and location of the well may be varied to accommodate available space and vessel operational requirements. The side and end walls of the inner hull structure are sloped inwardly in a downwardly direction toward the center of the hull well to form the hull well in a tapered shape.

The module of the integrated system includes an interior portion configured for a specific operational function and a universal, unitary outer shell which is downwardly, slidably and snugly receivable within the hull well. The module outer shell is composed of upright side and end walls which are joined to a base portion which rests on the floor structure of the hull when the module is inserted within the hull well. The module side and end walls are sloped complementary to the corresponding walls of the inner hull structure so that when the module is fully inserted within the hull well, the module side and end walls are disposed in adjacent, contacting, side-by-side relationship with the corresponding walls of the inner hull structure. Sloping the side and end walls of the inner hull structure and the module outer shell in this manner provides substantial clearance between the lower portion of the module outer shell and the upper portion of the hull well as the module is being initially inserted within the hull well so that precise alignment between the module and inner hull is not required. However, once the module has been fully inserted within the hull, the side and end walls of the module outer shell are in contacting side-by-side relationship with the corresponding walls of the inner hull structure thereby creating a tight, solid fit between the module and the hull. In addition, sloping the side and end walls of the inner hull structure and module outer shell prevents any binding between these components so that the module may be conviently removed from the hull well when desired.

According to another aspect of the present invention, a guiding system which forms an integral part of the inner hull structure and the module outer shell is provided for guiding the module into engagement with and disengagement from the inner hull structure and for preventing lateral movement between the module and the hull when the module is fully inserted within the inner hull structure. The guiding system includes a plurality of upright keyways formed within and extending along substantially the entire height of the upright walls of the inner hull structure to slidably receive corresponding keys extending along substantially the entire height of the upright side and end walls of the module outer shell. To faciliate engagement of the module keys with the inner hull keyways, preferably the lower end portions of the keys are tapered. It will be appreciated that by forming the guiding system in this manner, the module is accurately guided relative to the inner hull structure from the time the module initially downwardly enters the inner hull structure and subsequently during the entire downward travel of the module into the hull well and correspondingly during the entire upward travel of the module as it is removed from the hull. As a consequence, there is very little likelihood that the module would bind up with the inner hull structure either during insertion into or extraction from the hull.

In a further aspect of the present invention, a restraining system is provided for restraining relative vertical movement between the module and hull. The restraining system includes aligned clearance openings extending transversely through the keys and through the side wall portions of the keyways formed in the front and rear walls of the inner hull structure. A retaining pin is inserted within the aligned holes of the keyway and key. The pin is loaded in the transverse direction by a hold-down assembly anchored to the inner structure. The hold-down assembly includes a pair of hook members which engage with the end portions of the retaining pin. The opposite end of the hook members are mounted on a cross bar which in turn is anchored to the inner hull structure with a turnbuckle. By this construction of the restraining system, the retaining pin is conveniently inserted within the clearance holes provided in the keyway and key and then the transverse load imposed on the pin by the hold-down assembly securely locks the corresponding key and keyway against movement in the vertical direction.

According to an additional aspect of the present invention, the module is designed for purse seining, and includes a transverse bulkhead which divides the interior of the module into a forward fishhold area and a rearward machinery space. The fish hold and machinery space are covered by a flat deck. Refrigeration equipment is disposed within the machinery space for refrigerating the catch stored within the hold. The fishhold area is thermally insulated preferably with a rigid syntacic foam material which also provides structural strength to the entire module. The hold is divided into sections by guiderails which extend downardly from the module deck to guide containers in the form of baskets which are used to store the catch. A drum is mounted on the rear portion of the module deck over the machinery space for reeling in the seining net.

BRIEF DESCRIPTION OF THE DRAWINGS

The details of one typical embodiment of the present invention will be described in connection with the accompanying drawings in which:

FIG. 3 is an enlarged, fragmentary, perspective view illustrating the construction of the universal hull;

FIG. 4 is an enlarged cross-sectional view of the upper portion of the module outer shell shown engaged with the inner hull and specifically illustrating the watertight seal formed between the module and hull;

FIG. 5 is an enlarged cross-sectional view taken through the front, or back, wall of the inner hull and the front, or back, wall of the module outer shell specifically illustrating the construction of the service connection box of the inner hull and outer shell;

FIG. 6 is an enlarged, fragmentary, perspective view of portions of the rear or front wall of the inner hull and module outer shell specifically illustrating the construction of the retaining system which prevents relative vertical movement between the module and inner hull with the module illustrated as partially inserted within the hull;

FIG. 7 is a view similar to FIG. 6, however, with the module fully inserted within the hull and the restraining system in use;

FIG. 8 is a plan view of the module which is specifically designed for seining.

BEST MODE OF THE INVENTION

Figures 1, 2:
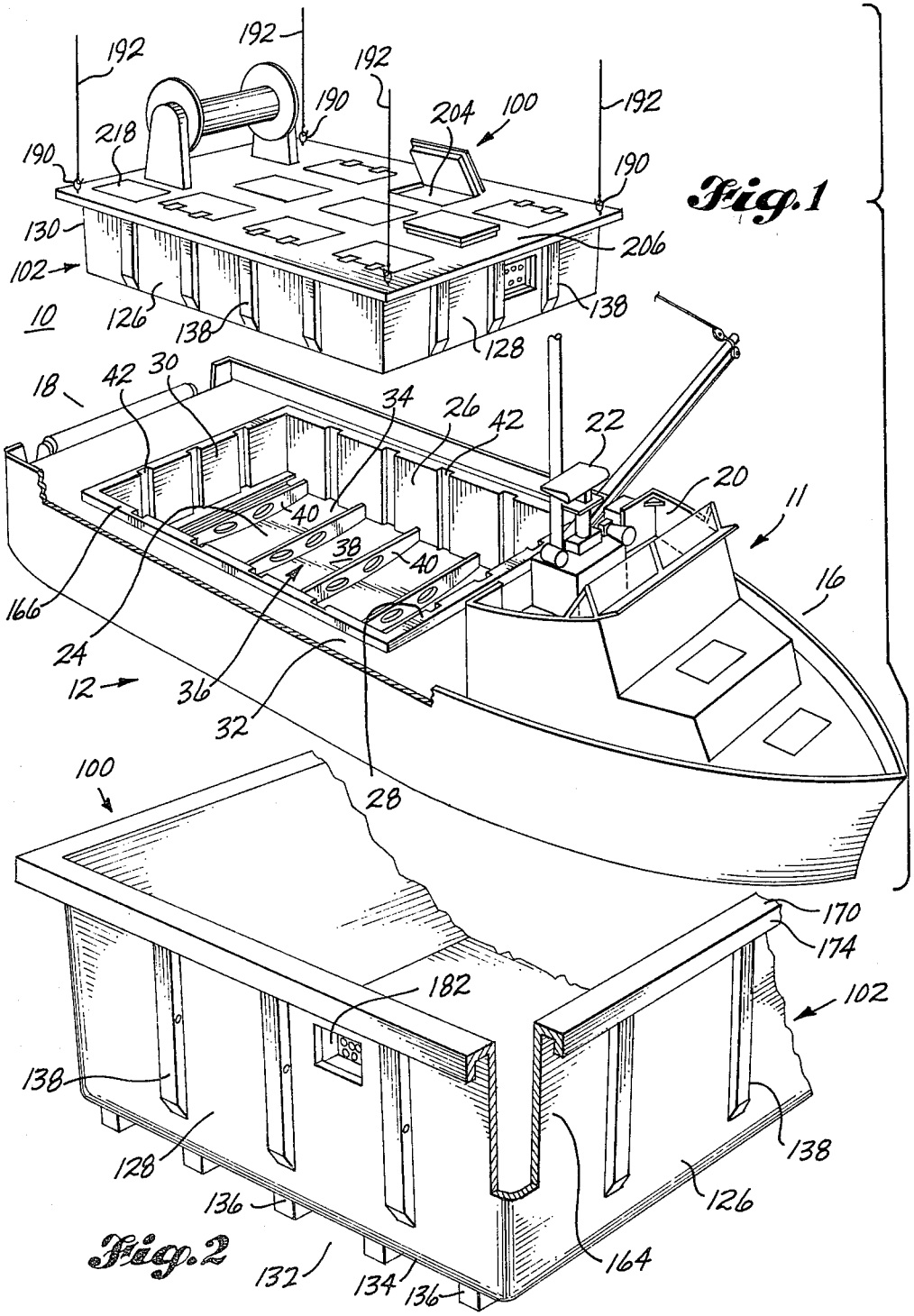
FIG. 1 is a perspective view of an integrated universal ship hull and module system constructed according to the present invention illustrating a module being lowered into or lifted outwardly from a universal hull, with portions of the hull broken away for clarity.
FIG. 2 is an enlarged, fragmentary perspective view of the outer shell of the module with portions broken away for clarity.

Referring initially to FIG. 1, an integrated vessel 11 composed of a ship hull and module system 10 constructed according to the best mode of the present invention currently known to applicant is shown as including a universal hull 12 designed to receive a module 100 which is constructed for a particular type of service, in this instance for seining. It is to be understood that module 100 can be replaced with other modules designed for different purposes, such as carrying personnel or cargo, conducting ocean or fresh water research, or patrolling.

Continuing to refer to FIG. 1, hull 12, which typically constitutes the more expensive component of system 10, includes a bow section 16 occupying the forward portion of the hull and a stern section 18 disposed at the rear of the hull. The bow and stern sections house equipment and provide services common to all vessel operations. For instance, a pilot house 20 is located in bow section 16 for housing steering and navigation equipment, including a radar system 22 and a pilot wheel, not shown. Preferably crew facilities and module support equipment, such as electrical generators and hydraulic or air pumps, not shown are also located in bow section 16. However, these support equiment may alternatively be located within the stern section 18 of hull 12. It is to be understood that the particular location chosen for placement of the engines, module support equipments, navigation and control equipment, and crew support facilities will depend on the size or shape or other parameters of the vessel.

Additionally referring to FIG. 3, hull 12 includes an inner hull 24 formed in part by interior side walls 26 and interior front and rear walls 28 and 30 which extend downwardly from an elevation slightly above the deck 32 to join the floor structure 34 of hull 12. Interior side wall 26 and front and rear walls 28 and 30 cooperate with hull floor structure 34 to define an upwardly open well 36 which extends longitudinally from bow 16 to stern 18 and across substantially the entire beam of hull 12. The bottom portion of the inner hull 24 is composed of floor structure 34 which forms the outer, bottom surface of the vessel and a plurality of transverse floors 40 which extend across substantially the entire width of hull 12 and are spaced apart along the length of the hull. Preferably, for maximum structural strength and minimum weight, floors 40 are generally disposed vertically edgewise over the lower hull 12. Ideally, the top edge of the floors 40 are aligned along a flat plane for conveniently supporting module 100 while the lower edge portion and ends of the floors are contoured to correspond to the cross sectional shape of the lower hull 12.

Interior side walls 26 and front and rear walls 28 and 30 preferably extend upwardly from floor plate 38 to an elevation slightly above the deck 32. The inner surfaces of the side walls 26 are sloped slightly, inwardly, at for instance 5°, as they extend downwardly from deck 32 toward the longitudinal center of hull 12. The inner surfaces of the front and rear interior walls 28 and 30 are also sloped inwardly, for instance at 5°. This can be accomplished by forming side, front and rear walls thicker as they extend downwardly, as illustrated in FIG. 3, or by forming the wall in uniform thickness and positioning the walls at a slope, toward the center of well 36 as they extend downwardly from deck 32. As discussed more fully below, sloping side, front and rear wall 26, 28, 30 in this manner results in a very close, precise fit between well 36 and module 100, and further assists in properly aligning the module as it is being inserted within the well.

Next referring to FIG. 5, a service connection box 44 is located over an opening 48 extending through either front or back wall 28 or 30 of inner hull 24 for making connections between service lines 49, 50, 51, with corresponding lines 49', 50', 51', of module 100 for supplying air, hydraulic, water or other types of service to the module. The ends of the lines 49, 50 and 51 extending within box 44 which are used for water, air or hydraulic service are preferably fitted with flexible, quick disconnecting couplers, which are well known and commonly available, for convenient connection with corresponding module lines 49', 50' and 51'. The ends of these lines which are used for electrical service preferably are fitted with a water and explosion proof socket as also commonly available. Grommets or other commonly available means, not shown, are provided to make a watertight seal between lines 49, 50 and 51 and the wall of service box 44. Service box 44 includes a watertight cover 60 which closes off an access opening formed in the service box.

Figure 9:
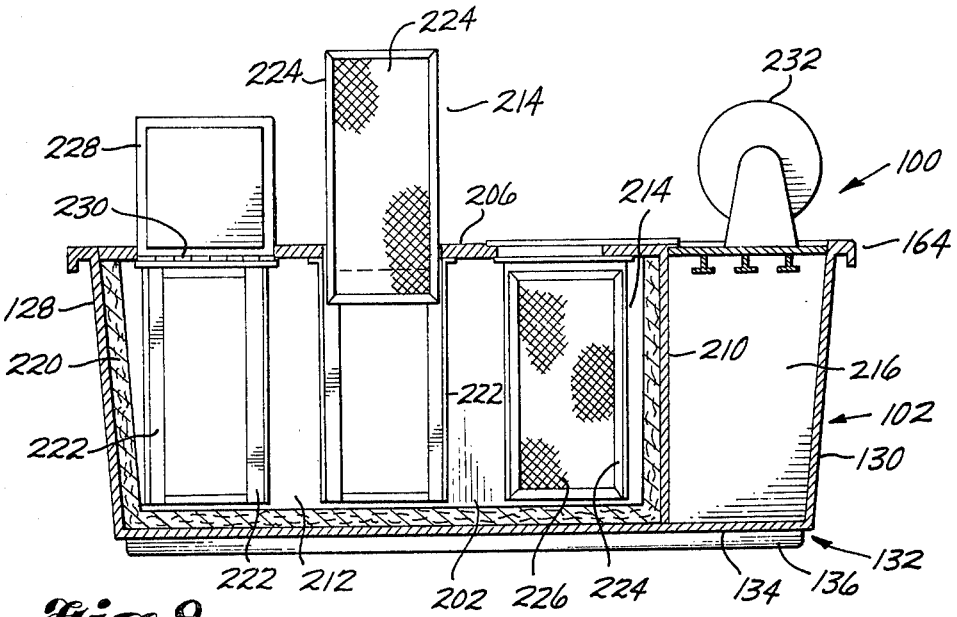
FIG. 9 is a cross-sectional view of the module illustrated in FIG. 8 taken substantially along lines 9—9 thereof.

As most clearly illustrated in FIGS. 1, 2 and 9, module 100 is composed of an outer unitary shell 102 which is common to all modules and an interior portion 204 and a deck portion 206 which is specific to the particular desired use of the module. As a specific, but not limiting example, module 100 is designed for purse seining. Module outer shell 102 is shaped and sized to be closely, downwardly receivable within well 36 of inner hull 24. The outer shell includes side walls 126, a front wall 128 and a rear wall 130 which correspond with inner hull side walls 26, front wall 28 and rear wall 30, respectively. Module side, front and rear walls 126, 128 and 130 also are sloped at the same angle as the corresponding walls of inner hull 24. Forming module outer shell 102 in this manner provides substantial clearance between module outer shell 102 and inner hull 24 at the top of well 36 when the module is being initially inserted into the inner hull thereby eliminating the need for precise alignment between the inner hull and module 100 and also allowing the module to enter and be extracted from well 36 without binding as would be the case if the inner hull and module outer shell were constructed from close fitting, vertical side, front and rear walls. In addition, when module 100 is fully inserted within inner hull 24, the corresponding taper of the side, front and rear walls of inner hull 24 and the side, front and rear walls of module outer shell 102 results in a tight face-to-face fit between the walls of the inner hull and the corresponding walls the of module outer shell. This tight fit would not be possible if inner hull 24 and module outer shell 102 were formed from vertical walls because of the clearance needed to be able to insert a module, such as module 100, within hull well 36.

Module outer shell 102 also includes a floor structure 132 composed of a floor pan 134 which intersects the lower edge portions of shell side, front and rear walls 126, 128 and 130 to form a watertight seal therebetween. Floor pan 134 may be integrally formed with walls 126, 128 and 130, or may be separately fabricated and then attached to the lower edges of these walls by any convenient means. Floor structure 132 also includes a plurality of elongate reinforcing members 136 extending longitudinally beneath floor pan 134 and spaced apart across the width of module outer shell 102. When module 100 is fully inserted within hull well 36, reinforcing members 136 bear downwardly on hull floors 40 to transfer the weight of the module uniformly about the hull. Reinforcing members 136 may be integrally constructed with floor pan 134 or may be fabricated of separate members depending upon the size of module 100, the type of material from which outer shell 102 is formed, the type of manufacturing facilities and techniques available, and other such relevant factors.

Guides are provided for properly aligning modules 100 relative to inner hull 24 during insertion and removal of the module from hull 12 and for preventing relative transverse and lateral movement between the module and the hull. The guides are composed of a plurality of vertical keyways 42 which extend along the entire height of inner hull side walls 26, front wall 28 and rear wall 30. Preferably the keyways 42 are somewhat evenly spaced apart from each other and are rectangular in cross section. However, keyways of other different cross-sectional shapes may be utilized. Ideally, as illustrated in FIGS. 1 and 3, interior walls 26, 28 and 30 are substantially thicker than the depth of keyways 42 so that the keyways are simply recessed within the walls. However, interior walls 26, 28 and 30 may be constructed from rather thin material which has been fabricated to form corresponding keyways 42.

The guides also include a plurality of upright keys 138 which extend along substantially the entire height of exterior surfaces of module outer shell sidewalls front, and end walls 126, 128 and 130 to slidably engage within corresponding keyways 42 of inner hull 24. Keys 136, which also function to reinforce outer shell 102, may be integrally formed with side walls, front and rear walls 126, 128 and 130 or may be separately formed and then mounted on these walls by any convenient means. Keys 138 are rectangular in cross section to match the preferred cross-sectional shape of keyways 42. Thus, it is to be understood that if keyways 42 are formed in another cross-sectional shape, keys 138 would be formed in a corresponding shape. Preferably, the lower ends of keys 138 are tapered as shown in FIGS. 2, 6 and 7 to enable the keys to be easily and slidably inserted within keyways 42 during lowering of module 100 within inner hull 24 without requiring precise alignment of the module relative to the inner hull.

It will be appreciated that by integrating keyways 41 into inner hull 24 and keys 138 into module outer shell 102 in this manner, the keys and keyways are capable of guiding module 100 relative to hull 12 for substantially the full travel of the module into and out of the hull. Thus, there will be very little, if any, tendency for the module to become misaligned relative to the hull. Also keys 138 and keyways 42 are disposed internally within the structure of vessel 11 so they do not protrude above the deck or get in the way of crewmen which could occur if other types of guiding means were used, such as the upwardly projecting aligning pins disclosed in the above-noted '838 patent. It is to be understood that the locations of keyways 42 and keys 138 can be reversed, e.g. the keys could be located on module outer shell 102, without departing from the scope of the present invention.

Once module 100 has been downwardly inserted into well 36, a novel retaining system is provided to prevent relative vertical movement between the module and inner hull 24. As illustrated in FIGS. 6 and 7, the restraining system includes an elongate, headed pin 140 which extends though aligned clearance holes extending transversely through walls 142 which form the sides of keyways 42 of inner hull front and rear walls 28 and 30. Pins 140 also extend through transverse clearance holes formed in keys 138 in registry with the associated clearance holes formed in keyway walls 142. Once pin 140 has been inserted through the clearance holes formed in key 138 and keyway 42, a washer 144 is engaged over the leading end of the pin and then the end of a generally circular spring clip 146 is inserted into a transverse hole cross drilled within the end of the pin thereby preventing the pin from disengaging from the key and keyway.

Preferably, for ease of insertion, the holes formed in keys 138 and keyways 42 are sized somewhat larger than the diameter of pin 140. Thus, to establish a solid connection between module 14 and hull 12 in the vertical direction, a hold-down assembly 148 is utilized to load the pin in a direction transversely to its length. As illustrated in FIG. 6 and 7, holddown assembly 148 includes a pair of hook members 150 pivotally mounted on opposite ends of a cross bar 152 which spans the width of keyway 42. The hook members 150 are downwardly open to engage with the end portions of pin 140 between the head of the pin and the adjacent sidewall 142 of keyway well 42 and between washer 144 and the adjacent sidewall of the keyway. Cross bar 152 is pivotally pinned to the clevis end of a threaded upper turnbuckle rod 154. A lower turnbuckle rod 156 is pivotally pinned to a lug 158 which is welded or otherwise fixedly attached to base wall 160 of keyway 42 at a location below the clearance holes formed in the keyway. A downward load is applied on pin 140 by rotating an internally threaded collar 162 engaged with rods 154 and 156 to apply a positive load between module 100 and inner hull 24 in the vertical direction. Access to pin 140 and hold-down assembly 148 is available through the engine compartment at the stern section of the hull and through the pilot house at the bow section of the hull. It is to be understood that although one particular method has been described for preventing relative vertical movement between module 100 and inner hull 24, other methods may be utilized without departing from the spirit or scope of the present invention.

Next referring to FIG. 4, a watertight, reusable seal is formed between the upper portion of module 100 and hull 12. To this end, a contoured rim 164 is formed around the upper edge portion of module outer shell 102 to engage over a ridge or tongue member 166 of inner hull 24. Tongue 166 is generally rectangular in cross-section and preferably is formed by extending the upper edges of inner hull side, front and rear walls 26, 28 and 30 upwardly above the elevation of deck 32. A bevel 168 extends along the upper outward edge of the tongue to facilitate engagement of the tongue within rim 164 when module 100 is lowered within inner hull 24.

Contoured rim 164 includes a transverse ledge portion 170 which extends horizontally outwardly from the upper edge of module outer shell side, front and rear walls 126, 128 and 130. The underside of ledge portion 170 is spaced slightly above the upper surface 172 of tongue 166 so that the weight of module 100 is not carried by the tongue. Rim 164 also includes a lip portion 174 which extends downwardly from the outer edge of ledge portion 172 to overlap the adjacent outward side surface 176 of tongue 166. The bottom edge of lip 174 is spaced slightly above the upper surface of deck 32 to prevent rim 164 from bottoming on the deck. A generally rectangular shaped groove 178 is formed in the side portion of lip 174 adjacent tongue side surface 176 for retaining a resilient seal 180 therein. Seal 180 is shaped and sized to press against groove 178 and tongue side surface 176 thereby to prevent moisture from reaching the abutting surfaces of inner hull 24 and module outer shell 102. It will be appreciated that although rim 164 can be constructed in other shapes and manners, the particular configuration of the rim set forth above enables seal 180 to be retained within groove 178 when module 100 is removed from hull 12, thereby permitting the seal to be conveniently reused when the module is subsequently reassembled on the same or another hull. It will also be appreciated that by contouring rim 164 in the manner described above, the rim adds significant structural rigidity to module outer shell 102.

Next referring to FIG. 5, module 100 also includes a service connection box 182 which is disposed over an opening formed in outer shell front wall 128 or back wall 130 in registry with the corresponding opening 48 formed in inner hull front wall 28. Service lines 49', 50' and 51' extend through the end wall of box 182 to interconnect with corresponding service lines 49, 50, and 51 disposed within hull service connection box 44. Preferably a watertight seal is formed between service lines 49', 50' and 51' and box 182 to prevent moisture from entering therein.

Referring to FIG. 1, lifting eyes 190 are located at the corners of module deck 206 for receiving the lower ends of lifting lines 192 used to lower module 100 into hull 12 and for removing the module from the hull. If required, the portions of module 100 adjacent to eyes 190 may be reinforced to carry the loads imposed by lines 192. It is to be understood that eyes 190 may be replaced with other types of structures which are capable of anchoring the lower ends of lines 192, such as sockets, not shown.

The interior portion 204 and deck 206 of the particular module 100 illustrated in FIGS. 1, 8 and 9, has been rigged for seining; however, as discussed more fully below, module 100 can be designed not only for fishing by other methods, but also for other uses, such as a personnel carrier, a research vessel, a small cargo carrier, or a patrol vessel. In the form of module 100 developed for seining, a transverse bulkhead 210 divides the interior of module shell 102 into a fishhold area 212 wherein fish are stored in individual containers in the form of baskets 214, and a smaller machinery space 216. Fishhold 212 and machinery space 216 are covered by a flat deck 206 which is coplanar with the top of rim ledge 170.

Refrigeration equipment, not shown, is disposed within machinery space 216 for refrigerating the catch stored within hold 212. Service for the refrigeration equipment is supplied from hull 12 through service box 182 to machinery space 216. Access to the machinery space is provided through a man-way 218 formed at an aft corner portion of deck 206.

Fishhold 212, as formed by module shell 102 and bulkhead 210, is preferably lined with a layer of rigid, syntactic foam 220 which thermally insulates the fishhold and also provides structural strength to the bottom of module 100. Preferably, foam layer 220 is covered with a smooth, impervious membrane liner which allows for easy cleaning of the exposed fishhold area. Hold 212 is divided into sections by basket guide rails 222 which extend vertically downwardly from the underside of deck 206 to foam layer 220. Guide rails 222 are formed in an angle-shape to each receive a corner of basket 214.

Basket 214, as illustrated in FIGS. 8 and 9, is generally rectangular in shape and is constructed with a perimeter frame 224 which is covered with screen material 226 to minimize the weight of the baskets, to allow the fish to be efficiently cooled by a refrigerant, and to allow water to drain out of the baskets. Preferably the bottom of each basket is formed from plate material to thereby uniformly distribute the weight of a catch over foam layer 220, which in turn distributes the weight about the module floor structure 132. The upper portion of baskets 214 are provided with hook openings or other appropriate means (not shown) for enabling the filled baskets to be conveniently lifted out of hold 212 when unloading the catch. Clearance openings are formed in deck 106 for passage of baskets 214, which openings are covered with insulated covers 228 hinged to deck 106 by a pair of hinges 230 or by insulated lift-off covers 231.

Refrigerant from the refrigeration unit, not shown, disposed within machinery space 216 is circulated through hold 212 between baskets 214. The refrigerated modules of the present invention can be readily utilized for fish caught by other methods, such as by trolling, gillnetting or long line fishing. For seining, a drum 232 is mounted on deck 206 over machinery space 216 for reeling in the seining net. Drum 232 may be hydraulically or electrically powered by hydraulic fluid or electricity provided from hull 12 through service lines 49'-52'.

Although module 100 is illustrated as particularly adapted for fishing, the module may be designed for other types of uses. For instance, vessel 11 may be used as a personnel carrier in which instance in lieu of fishhold 212 and machinery space 116, module 100 may be provided with a seating area with baggage storage space located below. The module may be covered by a canopy or other type of appropriate structure to protect the personnel from inclement weather.

An appropriate module may also be provided for utilizing vessel 11 as a small commercial ship to carry cargo. If dry cargo is to be transported, the fishhold and machinery areas 212 and 216 may be combined into a single large space with watertight hatches. If liquid cargo is to be transported, the fishhold area 212 may be redesigned as a baffled tank, or tanks with pumps disposed within machinery space 216 for pumping the liquid into and out of the tank.

Module 100 may also be designed to utilize vessel 11 for marine research. To this end, the fishhold and machinery areas could be combined to provide a laboratory beneath deck 32 and a house or working space, above the deck.

As a further alternative, module 100 can be configured to utilize vessel 11 as a patrol vessel. For this use, the module can be configured to suit the type of patrol activity for which it is intended. For instance, a portion of the fishhold area 212 can be utilized as an ammunition storage space with armament above, while the machinery space could contain necessary support equipment. Various types of armament which might be installed in this configuration of module 100, may include surface to air missiles, surface to surface missiles, fast firing automatic weapons, or assault rockets.

To utilize the present invention, module 100 may be conveniently inserted within hull 12 by lowering the module within well 36 by the use of lifting lines 192 attached to eyes 190 located at the corners of module deck 206. The tapered shape of module outer shell 102 provides a substantial amount of clearance between the lower portion of the module outer shell and the top of well 36 so that the module may be inserted within the well without requiring precise alignment therebetween. Moreover, the tapered lower ends of keys 138 facilitates engagement of the keys with corresponding keyways 42. When module 100 is fully lowered within well 36 of inner hull 24, the module floor structure 132 rests on the hull floor structure 34 to carry the weight of the hull. Also, the module outer shell side, front and rear walls 126, 128 and 130 are in face-to-face contact with the corresponding inner hull side, front and rear walls 26, 28 and 30. As module 100 is lowered within well 36, resilient seal 180, disposed within groove 178, automatically presses against the adjacent side surface 176 of tongue 166 to form a watertight seal between the module and the hull.

Once module 100 has been lowered into place, pins 140 of the retaining system are simply inserted within the clearance holes provides in keys 138 and keyways 42 and then the pins are transversely loaded by engagement of holddown assemblies 148 with corresponding pins. Lastly, by simply connecting service lines 49, 50, 51 and 52 with corresponding module service lines 49', 50', 51', and 52', vessel 11 is now ready for the particular service for which module 100 was designed. Module 100 is conveniently removed from hull 12 by simply reversing the above-described procedure.

As will be apparent to those skilled in the art to which the present invention is addressed, the present invention may be embodied in forms other than those specifically disclosed above without departing from the spirit or essential characteristics of the invention. The particular embodiment of the integral hull and module system 10, described above, is therefore to be considered in all respects as illustrative and not restrictive, i.e. the scope of the present invention is as set forth in the appended claims other than being limited to the example of the integral hull and module system 10, as set forth in the foregoing description.

What is claimed is:

1. An integral vessel hull and module system for interchangeably mounting on a universal vessel hull different function specific modules for converting the vessel for use for selected operational functions, the universal vessel hull having a propulsion engine, navigation and module support means, said system comprising:

(a) a universal hull having an inner hull structure composed of interior, upright walls extending downwardly from the deck of the hull to intersect a floor structure near the bottom of the hull to form an upwardly open well which occupies a major portion of the width of the vessel and a major portion of the length of the vessel;

(b) a replaceable, function specific module having an interior portion configured for a specific operational function of the vessel and a universal, unitary outer shell which is downwardly, slidably, snugly receivable within said hull well, said outer shell having:

upright walls disposed in adjacent, side-by-side relationship with corresponding upright walls of said inner hull structure when said module is inserted within said hull well, and a base portion which rests on the floor structure of said hull when said module is inserted within said hull well;

(c) guide means associated with said inner hull structure upright walls and with said module outer shell upright walls, for automatically aligning said module relative to said hull when said module is initially being inserted within said hull for guiding said module relative to said hull along substantially the entire relative movement of said module and hull during insertion and removal of said module into and from said hull and for restraining relative horizontal movement between said module and said hull, said guide means being integrated into the construction of the upright walls of the inner hull structure and the outer shell at spaced apart locations along the length of said upright walls; and, (d) restraining means for restraining relative vertical movement between said module and said hull.

2. The system according to claim 1, wherein said module outer shell base portion including elongate reinforcing members spaced apart from each other about said base portion to strengthen said base portion and distribute the weight carried by said module about said hull floor structure.

3. The system according to claim 2, wherein said reinforcing members being disposed along the underside of said module outer shell base portion.

4. The system according to claim 1, wherein said module includes a storage hold that is lined with thermal insulation both to insulate said storage hold and to structurally reinforce said module.

5. The system according to claim 4, wherein said module includes a deck structure spanning over the top of said module outer shell and a plurality of individual storage containers downwardly disposable within said stroage hold through openings formed in said module deck.

6. The system according to claim 5, wherein said module further includes guide rail means depending downwardly from said module deck structure for guiding said storage containers as they are lowered downwardly within said storage hold and for restraining said storage containers against lateral movement once they are lowered downwardly into said storage hold.

7. The system according to claim 1, wherein said guide means includes:

forming said inner hull structure with its upright walls sloped inwardly in the downwardly direction toward the center of the hull well;

forming said module outer shell with its upright walls sloped complementary to associated walls of said inner hull structure;

a plurality of upright keyways extending along the upright walls of either said inner hull structure or said module outer shell; and a plurality of upright keys extending along the upright walls of the other of said inner hull structure or said module outer shell at locations in registry with a corresponding keyway.

8. The system according to claim 7, wherein:

said keyways extending along substantially the entire height of the interior portions of said inner hull structure upright walls; and said keys extending along substantially the entire height of the outside surfaces of said module outer shell upright walls both to engage within a corresponding keyway as said module is lowered into said hull and to reinforce said module outer shell.

9. The system according to claim 8, wherein each of said keys having a tapered lower end portion for automatically guiding said keys into initial engagement within an associated keyway.

10. The system according to claim 1, further comprising sealing means for forming a watertight seal between the upper portions of said module outer shell and said hull when said module is disposed within said hull well, said sealing means including:

an upstanding ridge extending around the perimeter of said hull well and extending upwardly above the adjacent portions of said hull;

a contoured rim extending around the upper portion of said module outer shell, said rim having a transverse ledge portion extending transversely outwardly from the upper edge portion of said outer shell side and end walls at an elevation slightly above said hull ridge and a lip portion depending downwardly from the outer edge portion of said ledge to overlap the adjacent side portion of said hull ridge; and resilient gasket means disposed between said module rim lip and the adjacent side portion of said hull ridge.

11. The system according to claim 10, wherein portions of said module rim lip forming a groove for retaining said resilient gasket means.

12. The system according to claim 10, wherein said rim being integrally formed with said module outer shell.

13. An integral vessel hull and module system for interchangeably mounting on a vessel hull different modules designed for various operational functions, the vessel hull having propulsion, navigation and module support means, said system comprising:

(a) a universal hull having an inner hull structure composed of interior, upright walls extending downwardly from the deck of the hull to intersect a floor structure near the bottom of the hull to form an upwardly open well which occupies a substantial portion of the width of the vessel and a substantial portion of the length of the vessel;

(b) a replaceable module having an interior portion configured for a specific operational function and a universal, unitary outer shell which is downwardly, slidably, snugly receivable within said hull well, said outer shell having:

upright walls disposed in adjacent side-by-side relationship with corresponding upright walls of said inner hull structure when said module is inserted within said hull well, and a base portion which rests on the floor structure of said hull when said module is inserted within said hull well;

(c) guide means associated with said inner hull structure upright walls and with said module outer shell upright walls, for automatically aligning said module relative to said hull when said module is initially being inserted within said hull for guiding said module relative to said hull along substantially the entire relative movement of said module and hull during insertion and removal of said module into and from said hull and for restraining relative horizontal movement between said module and said hull;

(d) wherein said guide means includes:

forming said inner hull structure with its upright walls sloped inwardly in the downwardly direction toward the center of the hull well;

forming said module outer shell with its upright walls sloped complementary to associated walls of said inner hull structure;

a plurality of upright keyways extending along the upright walls of either said inner hull structure or said module outer shell; and a plurality of upright keys extending along the upright walls of the other of said inner hull structure or said module outer shell at locations in registry with a corresponding keyway; and, (e) restraining means for restraining relative vertical movement between said module and said hull, wherein said restraining means, comprising:

aligned through openings extending transversely through said keys and through the side wall portions of said keyways;

a pin engageable through each of said key and keyway aligned openings; and load means for applying a load on said pin in a direction transversely to the length of said pin.

14. The system according to claim 13, wherein said load means applying a load on the end oportions of said pins.

15. For a vessel having a universal inner hull structure composed of interior walls extending downwardly from the deck of the hull to intersect a hull floor structure thereby to form an upwardly open well, the inner hull interior walls being sloped in the downward direction toward the center of the well, the improvement comprising:

a replaceable module having a universal, unitary outer shell and an inner portion designed to convert the vessel for use for a specific nonpropulsionally related operational function based on the configuration of the inner portion of said module, the module outer shell being downwardly, slidably receivable within the hull well and having:

upright side and end walls sloped complementary to the corresponding walls of the inner hull structure so that the module side and end walls are disposed in adjacent side-by-side relationship with the corresponding walls of the inner hull structure when said module is fully inserted within the hull well; and a base portion which rests on the floor structure of the hull when said module is inserted with the hull well;

guide means forming a part of the inner hull structure walls at locations spaced apart along the length of the inner hull structure walls and forming a part of the module outer shell side and end walls at locations spaced apart along the length of the side and end walls for guiding said module into engagement with and disengagement from the inner hull structure during substantially the entire relative movement occurring between the inner hull structure and said module during insertion and removal of said module into and from the inner hull structure, and for restraining substantially all relative horizontal movement between said module and the inner hull when said module is fully inserted within the inner hull structure;

restraining means for restraining relative vertical movement between said module and the inner hull structure; and, sealing means for forming a watertight seal between the perimeter of said module and the hull, said sealing means including:

a hull upright sealing surface extending around the perimeter of the hull well;

an upright module sealing surface extending around the perimeter of said module outer shell; and resilient sealing means mounted on either said module sealing surface or said hull sealing surface prior to insertion of said module within the hull.

16. The improvement according to claim 15, wherein said module outer shell base portion includes elongate reinforcing members spaced apart from each other about said base portion to strengthen said base portion and distribute the weight carried by said module about the hull floor structure.

17. The improvement according to claim 16, wherein said reinforcing members are disposed along the underside of the module outer shell base portion.

18. The improvement according to claim 15, wherein said module includes a storage hold that is lined with rigid thermal insulation both to insulate said storage hold and to structurally reinforce said module.

19. The improvement according to claim 18, wherein said module further includes:

a deck structure spanning over the said module outer shell, said deck structure having a plurality of openings formed therein;

a plurality of individual storage containers downwardly insertable within said storage hold through said deck openings; and container guide means depending downwardly from said deck for guiding said storage containers as they are lowered downwardly within said storage hold and for restraining said containers against lateral movement once they are lowered into said storage hold.

20. The improvement according to claim 15, wherein said guide means includes:

a plurality of upright keyways integrally formed within and extending substantially along the entire height of the walls of the inner hull structure or the side and end walls of said module outer shell; and a plurality of upright keyways integrally formed with and extending substantially along the entire height of the other of the walls of the inner hull structure or the side and end walls of said module outer shell at locations in registry with a corresponding keyway.

21. The improvement according to claim 20, wherein each of said keys having a tapered lower end portion for guiding said keys into initial engagement within an associated keyway.

22. The improvement according to claim 15, wherein:

said hull upright sealing surface including an upstanding ridge both extending around the perimeter of the hull well and extending upwardly above the adjacent portions of the hull;

said module including a contoured rim extending around the upper portion of said outer shell, said rim having a transverse ledge portion extending transversely outwardly from the upper edge portion of said upper shell side and end walls at an elevation slightly above said hull ridge, and a lip portion depending downardly from the outer edge portion of said ledge to overlap the adjacent side portion of said hull ridge to form the module upright sealing surface; and said resilient sealing means including gasket means disposed between said module rim lip and the adjacent side portion of said hull ridge.

23. The improvement according to claim 22, wherein portions of said module rim lip form a groove for retaining said resilient gasket means.

24. For a vessel having a universal inner hull structure composed of interior walls extending downwardly from the deck of the hull to intersect a hull floor structure thereby to form an upwardly open well, the inner hull interior walls being sloped in the downwardly direction toward the center of the well, the improvement comprising:

(a) a replaceable module designed to adapt the vessel for a specific operational function, said replaceable module having a universal, unitary outer shell which is downwardly, slidably receivable within the hull well and having:

upright side and end walls sloped complementary to the corresponding walls of the inner hull structure so that the module side and end walls are disposed in adjacent side-by-side relationship with the corresponding walls of the inner hull structure when said module is fully inserted within the hull well; and a base portion which rests on the floor structure of the hull when said module is inserted within the hull well;

(b) guide means forming a part of the inner hull structure walls at spaced apart locations along the inner hull structure walls and a part of the module outer shell side and end walls for guiding said module into engagement with and disengagement from the inner hull structure during substantially the entire relative movement occurring between the inner hull structure and said module during insertion and removal of said module into and from the inner hull structure, and for restraining relative horizontal movement between said module and the inner hull when said module is fully inserted within the inner hull structure;

(c) restraining means for restraining relative vertical movement between said module and the inner hull structure;

(d) sealing means for forming a watertight seal between the perimeter of said module and the hull, said sealing means including:

a hull upright sealing surface extending around the perimeter of the hull well;

an upright module sealing surface extending around the perimeter of said module outer shell; and resilient sealing means mounted on either said module sealing surface or said hull sealing surface prior to insertion of said module within the hull;

(e) wherein said guide means includes:

a plurality of upright keyways integrally formed with and extending substantially along the entire height of the walls of the inner hull structure or the side and end walls of said module outer shell; and a plurality of upright keys integrally formed with and extending substantially along the entire height of the walls of the inner hull structure or the side and end walls of said module outer shell at the locations in registry with a corresponding keyway; and, (f) wherein said restraining means, comprising:

aligned through holes extending tranversely through said keys and through the sidewall portions of said keyways;

a pin engageable through each of said key and keyway aligned openings; and load means for applying a load on said pin in a direction transversely to the length of said pin.

* * * * *

UNITED STATES PATENT AND TRADEMARK OFFICE

CERTIFICATE OF CORRECTION

PATENT NO. : 4,476,798

DATED : October 16, 1984

INVENTOR(S) : George S. Backus

It is certified that error appears in the above-identified patent and that said Letters Patent is hereby corrected as shown below:

Column 13, line 64: "oportions" should be — portions —.

Column 14, line 20: "with" should be — within —.

Signed and Sealed this

*Twenty-fifth* Day of *June 1985*

[SEAL]

*Attest:*

DONALD J. QUIGG

*Attesting Officer* *Acting Commissioner of Patents and Trademarks*